US006392605B2

(12) United States Patent
Anterow

(10) Patent No.: US 6,392,605 B2
(45) Date of Patent: May 21, 2002

(54) ANTENNA FOR A HANDSET

(75) Inventor: Aleksis Anterow, Copenhagen (DK)

(73) Assignee: Nokia Mobile Phones, Limited, Espoo (FI)

( * ) Notice: Subject to any disclaimer, the term of this patent is extended or adjusted under 35 U.S.C. 154(b) by 0 days.

(21) Appl. No.: 09/773,525

(22) Filed: Feb. 2, 2001

(30) Foreign Application Priority Data

Feb. 2, 2000 (GB) ..... 0002406

(51) Int. Cl.[7] ..... H01Q 1/24
(52) U.S. Cl. ..... 343/702; 343/700 MS
(58) Field of Search ..... 343/700 MS, 702, 343/841, 846, 848; 29/600

(56) References Cited

U.S. PATENT DOCUMENTS

| | | | | | |
|---|---|---|---|---|---|
| 4,167,010 | A | | 9/1979 | Kerr | 343/700 MS |
| 4,320,401 | A | | 3/1982 | Schiavone | 343/700 MS |
| 4,356,492 | A | | 10/1982 | Kaloi | 343/700 MS |
| 4,990,927 | A | | 2/1991 | Ieda | 343/700 MS |
| 5,241,321 | A | | 8/1993 | Tsao | 343/700 MS |
| 5,764,190 | A | | 6/1998 | Murch et al. | 343/702 |
| 5,926,139 | A | | 7/1999 | Korisch | 343/702 |
| 5,943,019 | A | * | 8/1999 | Kawahata et al. | 343/702 |
| 6,008,762 | A | | 12/1999 | Nghiem | 343/700 MS |
| 6,114,996 | A | * | 9/2000 | Nghiem | 343/700 MS |
| 6,140,966 | A | * | 10/2000 | Pankinaho | 343/700 MS |
| 6,184,833 | B1 | * | 2/2001 | Tran | 343/700 MS |
| 6,225,951 | B1 | * | 5/2001 | Holshouser et al. | 343/700 MS |

FOREIGN PATENT DOCUMENTS

| | | | |
|---|---|---|---|
| DE | 4329123 | A1 | 8/1993 |
| EP | 0376074 | | 12/1989 |
| EP | 0892459 | A1 | 1/1999 |
| EP | 0923156 | A1 | 6/1999 |
| EP | 0997974 | A1 | 5/2000 |
| GB | 2150356 | A | 6/1985 |
| GB | 2345022 | | 6/2000 |
| GB | 2345194 | | 6/2000 |
| GB | 2345195 | | 6/2000 |
| WO | 95/24746 | | 9/1995 |
| WO | 98/44588 | | 10/1998 |
| WO | 98/49743 | | 11/1998 |
| WO | 99/28990 | | 1/1999 |
| WO | 99/21245 | | 4/1999 |
| WO | 99/38227 | | 7/1999 |
| WO | 00/03452 | | 1/2000 |

OTHER PUBLICATIONS

IEEE Transactions on Antennas and Propagation, vol. 45, No. 10, Oct. 1997.

"A Compact PIFA Suitable for Dual Frequency 900/1800MHz" By Rowel, et al.

* cited by examiner

*Primary Examiner*—Tan Ho
(74) *Attorney, Agent, or Firm*—Antonelli, Terry, Stout & Kraus, LLP

(57) ABSTRACT

A dual band antenna device has a first conducting layer acting as resonator plane for the antenna device, a dielectric body on which said first conducting layer is provided and a second conducting layer, that is in substantial parallel with the first conducting layer, and acting as ground plane. The first conducting layer comprises two branches, and both branches will contribute to the matching of the antenna device in both hands.

29 Claims, 4 Drawing Sheets

ANTENNA FOR A HANDSET

BACKGROUND OF THE INVENTION

The invention relates to a dual band antenna for a handset. Such an antenna includes a metallic plate or layer acting as ground plane for the antenna, a resonator plate or layer acting as radiating element(s), and a feeding point supplying the signal to the antenna.

The applicant launched recently a new GSM dual band phone named Nokia 3210™. This phone has a dielectric antenna body covered by a metallic pattern forming two radiating elements—one for each band. The dielectric antenna body is inside the phone snapped onto a metallic shield acting as resonator plane. The antenna used in Nokia 3210™ is a PIFA (Planar Inverted F-Antennas) antenna and is described in GB 9828533.1, GB 9828364.1, and GB 9828535.6—all filed in December 1998.

WO 95/24746 describes a single band internal antenna having a dielectric body coated with a metallic layer on two substantially parallel surfaces.

U.S. Pat. No. 5,764,190 describes a capacity loaded PIFA according to which an extra plate is interposed in between the ground plane and the radiating element.

U.S. Pat. No. 5,764,190 describes how to provide a longitudinal slit in the resonator layer in order to obtain two radiating elements. A capacitive feeding concept is used.

A letter by Z. D. Lui and P. S. Hall, "Dual-Frequency Planar Inverted-F Antenna", is published in IEEE Transactions on Antennas and Propagation, October 1997, Volume 45, Number 10. This letter describes a number of solutions—one of these having a rectangular patch for the 900 MHz band. This patch is provided with an L-shaped slot separating one quarter of the 900 MHz band for acting as resonating element in 1800 MHz band. GSM works in the 900 MHz band (uplink: 890–915 MHz (mobile to base-station), and downlink: 935–960 MHz (base-station to mobile)) and in the 1800 MHz band (uplink: 1710–1785 MHz (mobile to base-station), and downlink: 1805–1880 MHz (base-station to mobile)).

SUMMARY OF THE INVENTION

An object of the invention is to provide a dual band antenna having a reduced overall size.

This object is achieved by a dual antenna device having a first conducting layer acting as resonator plane for the antenna device, a second conducting layer, that is substantially parallel with the first conducting layer, and acting as ground plane, and a dielectric body on which said first conducting layer is provided. The first conducting layer comprises two branches, and both branches will contribute to the matching of the antenna device in both hands. Hereby the full patch area may be used either for radiating an electromagnetic field or for mating the antenna.

Preferably the one of said two branches is quarter-wave resonant in a first one of said two bands, and half-way resonant in a second one of said two bands, while the second one of said two branches provides a resonant matching in said first one of said two bands, and will appear as a quarter-wave resonant stub in said second one of said two bands. When the antenna device is used in a GSM dual band phone the two bands will have center frequencies in approximately 920 MHz and in approximately 1800 MHz, respectively.

By placing the strips of the feeding means in parallel close together the Q-value of the antenna will be reduced and hence the bandwidth of the antenna will be increased. Also this arrangement provides better flexibility for the patch layout since the feed occupies less area on the patch.

According to the referred embodiment the antenna elements constituted by the branches have been folded in order to reduce the RF coupling between the two branches. This can be done by locating the open ends away from each other, as well as aligning the currents of the two at 90 degrees angle. Hereby the capacitive coupling between the open ends of the stubs (electrical field) will be reduced. Furthermore the inductive coupling between the branches where the currents are strong (close to the feed and at 1800 MHz at the middle of the 900 MHz as well) will be reduced. Locating the feed close to the edge of the PCB will also increase bandwidth.

Besides minimizing the coupling voltage/voltage and current/current of the two branches, the layout distributes the currents in a large area of the patch, which is desirable.

BRIEF DESCRIPTION OF THE DRAWING

For a better understanding of the present invention and to understand how the same may be brought into effect reference will now be made, by way of example only, to accompanying drawings, in which.

DETAILED DESCRIPTION OF EMBODIMENTS

Figure 1:
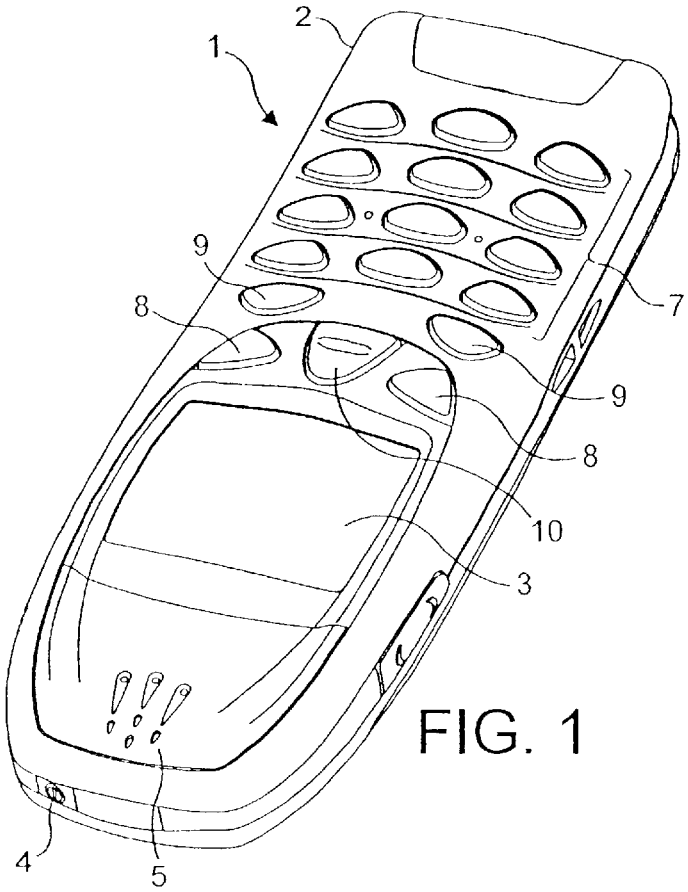
FIGS. 1 and 2 illustrates in perspective a preferred embodiment of a hand portable phone according to the invention seen from the front and rear side, respectively.
Figure 2:
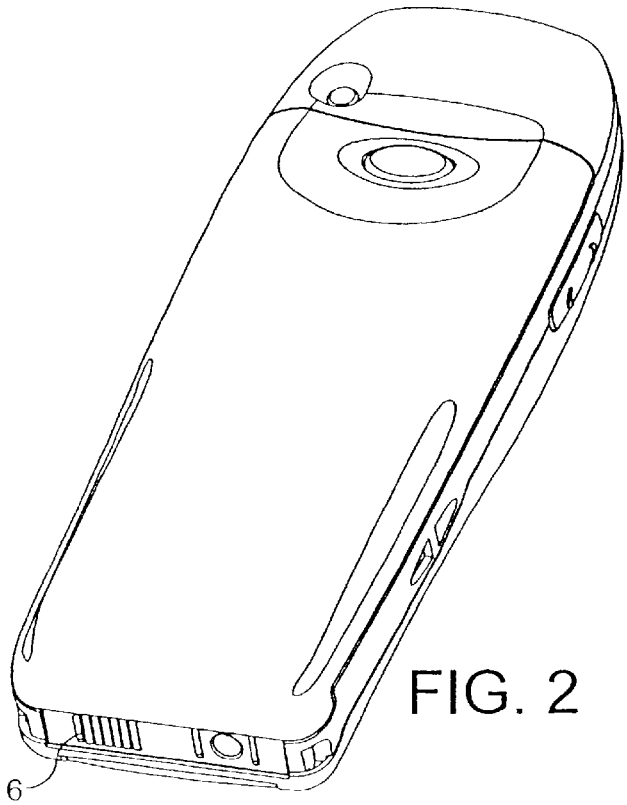

FIGS. 1 and 2 shows a preferred embodiment of a phone according to the invention, and it will be seen that the phone, which is generally designated by 1, comprises a user interface having a keypad 2, a display 3, an on/off button 4, a speaker 5, and a microphone 6 (only openings are shown). The phone 1 according to the preferred embodiment is adapted for communication via a cellular network, but could have been designed for a cordless network as well.

According to the preferred embodiment the keypad 2 has a first group 7 of keys as alphanumeric keys, two soft keys 8, two call handling keys 9, and a cursor navigation key 10. The present functionality of the soft keys 8 is shown in separate fields in the display 3 just above the keys 8, and the call handling keys 9 are used for establishing a call or a conference call, terminating a call or rejecting an incoming call.

Figure 3:
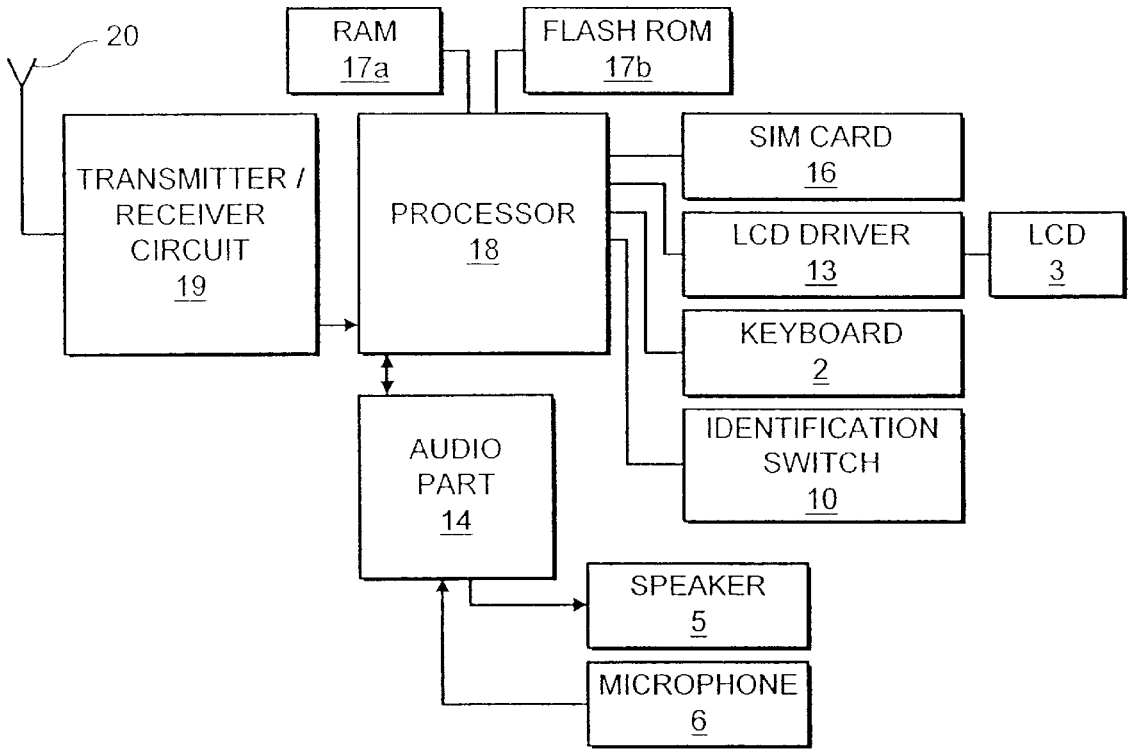
FIG. 3 schematically shows the essential parts of a telephone for communication with a cellular or cordless network.

FIG. 3 schematically shows the most important parts of a preferred embodiment of the phone, said parts being essential to the understanding of the invention. The preferred embodiment of the phone of the invention is adapted for use in connection with a GSM 900 MHz and a GSM 1800 MHz network. The processor 18 controls the communication with the network via the transmitter/receiver circuit 19 and an internal antenna 20 that will be discussed in details below.

The microphone 6 transforms the user's speech into analog signals, the analog signals formed thereby are A/D converted in an A/D converter (not shown) before the speech is encoded in an audio part 14. The encoded speech signal is transferred to the processor 18, which i.a. supports the GSM terminal software. The processor 18 also forms the interface to the peripheral units of the apparatus, including a RAM memory 17*a* and a Flash ROM memory 17*b*, a SIM card 16, the display 3 and the keypad 2 (as well as data, power supply, etc.). The audio part 14 speech-decodes the signal, which is transferred from the processor 18 to the earpiece 5 via a D/A converter (not shown).

According to the preferred embodiment of the invention the antenna is based upon the PIFA principle. In order to achieve optimum performance at two frequency bands, the GSM 900 MHz band and GSM 1800 MHz band, according to the preferred embodiment shown in FIGS. 4, 5 and 6, the patch 24 consists of two branches 25, 26 connected in parallel to the feed of the antenna. One branch 26 is quarter-wave resonant at approximately 920 MHz (centre of GSM 900 MHz band), the other branch 25 provides a resonant matching at approximately 1800 MHz (centre of 1800 MHz band). At 1800 MHz, the 900 MHz branch 26 will basically be half-wave resonant, whereas the 1800 MHz branch 25 will appear as a quarter-wave resonant stub. However, both branches 25, 26 will in both bands contribute to the matching of the antenna 20.

Figure 4:
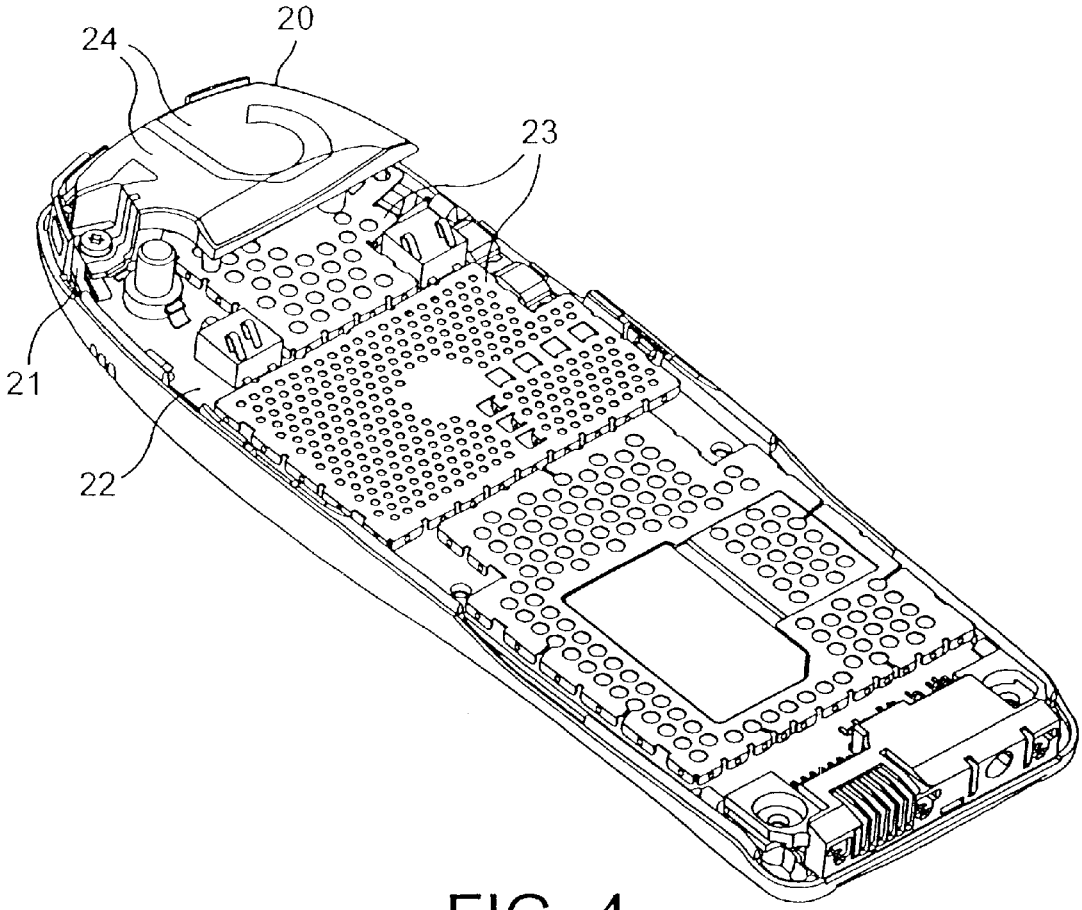
FIG. 4 shows in perspective view the antenna body mounted onto a metallic inner cover of the phone shown in FIGS. 1 and 2.
Figure 5:
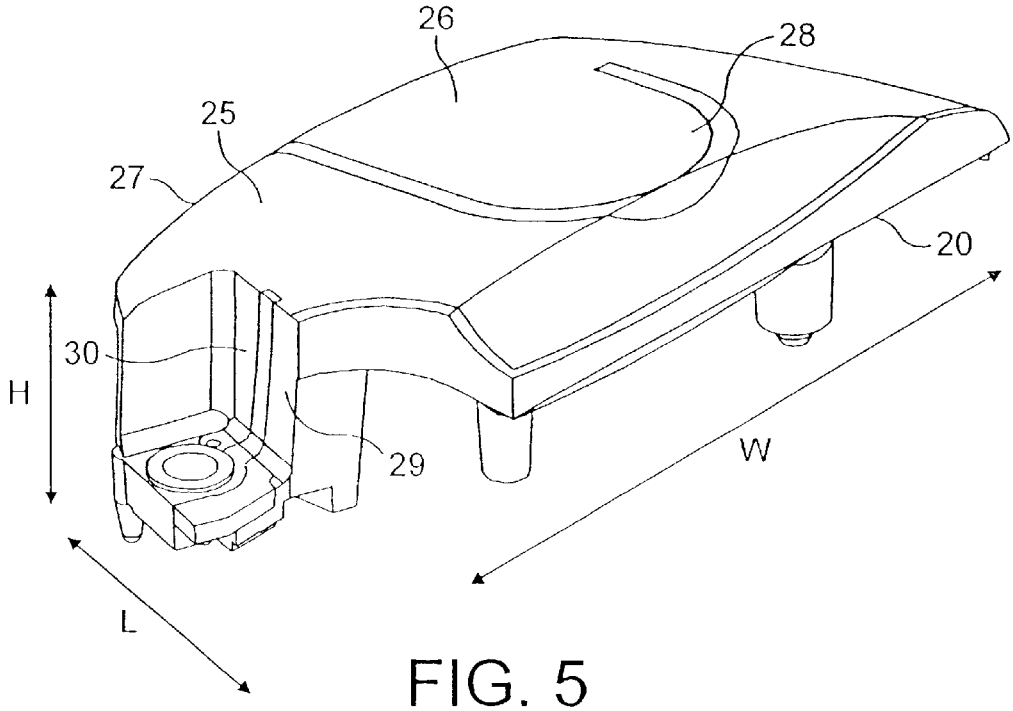
FIGS. 5 and 6 illustrate in perspective details of the antenna body according to the invention seen from the front and rear side, respectively.

In FIG. 4 the rear cover of the phone shown in FIG. 1 and 2 has been removed in order to expose the internal parts of the phone. It is seen how the antenna 20 is fixed to a Printed Circuit Board 22 of the phone by means of a screw 21. The antenna 20 is coated with metallic patches 24 constituting the radiating antenna elements, while metallic shielding cans 23 provides the ground plane of the PIFA antenna.

In order to reduce the size of the antenna without sacrificing bandwidth, the patches have been folded in a specific manner. Bandwidth will benefit from reducing the RF coupling between the two branches 25, 26. What is desired is to reduce the capacitive coupling between the open ends 27, 28 of the stubs (electrical field) and reduce the inductive coupling between the branches where the currents are strong (close to the feed 29 and at 1800 MHz at the middle of the 900 MHz as well). This can be done by locating the open ends away from each other, as well as aligning the currents of the two at 90 degrees angle. Locating the feed 29 close to the edge of the PCB will also increase bandwidth.

Besides minimizing the coupling voltage/voltage and current/current of the two branches 25, 26, the layout distributes the currents in a large area of the patch, which is desirable.

The two branches 25, 26 will influence each other regarding tuning of the centre frequencies. The obvious way of tuning the antenna is to increase/decrease the length of the branches, but this will not provide optimum tuning since they both affect the 900 MHz as well as the 1800 MHz frequencies. In order to simultaneously matches both bands, capacitive coupling between the two branches as well as between the first part and the end 28 of the 900 MHz branch 26 has been used. Also, the inductance along the length of the patches has been carefully tuned for achieving best bandwidth as well as centering both bands of operation. The feeding of the patch consists of two strips 29, 30—one of these strips 29 is connected to the RF feed provided on the PCB 22 via a not shown standard spring connector, and the other strip 30 is connected to ground of the PCB 22, and a screw 21 is used for ensuring a sufficient mechanical pressure. The strips 29, 30 have been located close together in order to reduce the Q-value of the antenna 20 and hence increase the bandwidth of the antenna. Also this arrangement provides better flexibility for the patch layout since the feed occupies less area on the patch.

Figure 6:
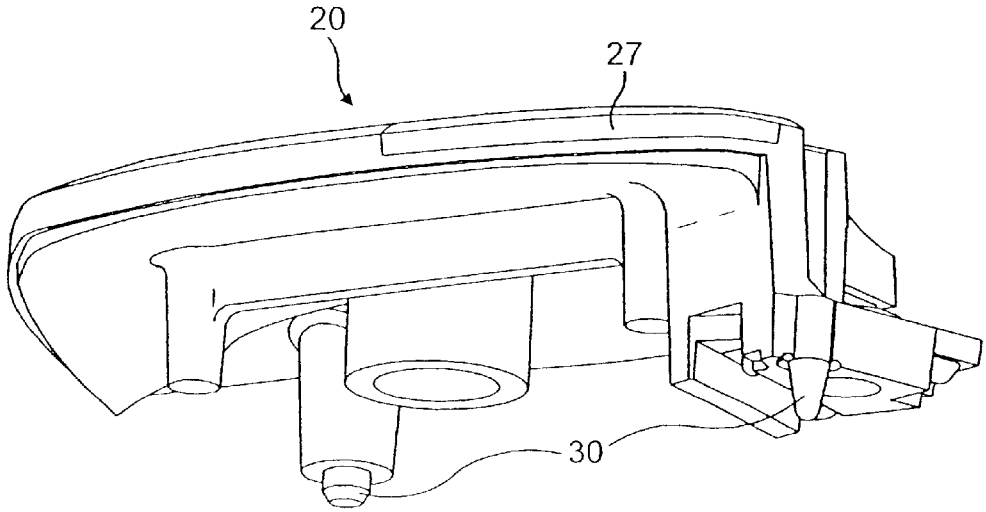

From FIG. 6 it is seen how the antenna 20 is provided with guide pins 30 to prevent the antenna 20 against a displacement relative to the PCB 22. It has been verified that the antenna as claimed fulfills the requirements for type approval for a GSM 900/1800 MHz phone. This means that the antenna provides a sufficient gain in both frequency bands. The overall width W of the antenna is 36 mm, the length L of the antenna is 19 mm and the height H is 9 mm.

What is claimed is:

1. An antenna device comprising:

a first conducting layer acting as resonator plane for the antenna device;

a second conducting layer, that is substantially parallel with the first conducting layer, and acting as ground plane; and a dielectric body on which said first conducting layer is provided, said first conducting layer comprising two branches, and both branches contribute to the matching of the antenna device in two frequency bands, wherein a first one of said two branches is quarter-wave resonant in a first one of said two frequency bands, and half-wave resonant in a second one of said two frequency bands; and a second one of said two branches provides a resonant matching in said first one of said two frequency bands, and appears as a quarter-wave resonant stub in said second one of said two frequency bands.

2. An antenna device according to claim 1, wherein said two frequency bands have center frequencies at approximately 920 MHz and at approximately 1800 MHz, respectively.

3. An antenna device comprising:

a first conducting layer acting as resonator plane for the antenna device;

a second conducting layer, that is substantially parallel with the first conducting layer, and acting as ground plane; and a dielectric body on which said first conducting layer is provided, said first conducting layer comprising two branches, and both branches contribute to the matching of the antenna device in two frequency bands, wherein the branches have been folded in order to reduce the RF coupling between the two branches.

4. An antenna device according to claim 3, wherein the open ends of the antenna elements constituted by the branches are located away from each other.

5. An antenna device according to claim 3, wherein the currents running in the two antenna elements constituted by the branches are aligned at 90 degrees angle.

6. An antenna device comprising:

a first conducting layer acting as resonator plane for the antenna device;

a second conducting layer, that is substantially parallel with the first conducting layer, and acting as ground plane; and a dielectric body on which said first conducting layer is provided, said first conducting layer comprising two branches, and both branches will contribute to the matching of the antenna device in two frequency bands, wherein the dielectric body is provided by a two shots injection-molding process.

7. An antenna device according to claim 6, wherein the first conducting layer acting as resonator plane is coated onto the dielectric body.

8. An antenna device according to claim 6, wherein feeding means of the antenna device comprises two strips—one connecting the second conducting layer to ground and one connecting the first conducting layer to a signal source.

9. An antenna device according to claim 6, wherein the feeding means of the antenna device are located in parallel close together.

10. A handportable phone having a dual band antenna device comprising:

a first conducting layer acting as resonator plane for the antenna device;

a second conducting layer, that is in substantial parallel with the first conducting layer, and acting as ground plane; and a dielectric body on which said first conducting layer is provided, said first conducting layer comprising two branches, and both branches in two frequency bands contribute to the matching of the antenna device, wherein a first one of said two branches acts as a quarter-wave resonant antenna element in a first one of two frequency bands, and as half-wave resonant antenna element in a second one of said two frequency bands, and a second one of said two branches provides a resonant matching element for the resonant antenna element provided by the first one of said two branches in each of said two frequency bands.

11. A handportable phone according to claim 10, wherein said second one of said two branches provides a resonant matching in said first one of said two frequency bands and a quarter-wave resonant stud in said second one of said two frequency bands.

12. A handportable device according to claim 10, wherein said two frequency bands have center frequencies at approximately 920 MHz and at approximately 1800 MHz, respectively.

13. A handportable phone having a dual band antenna device comprising:

a first conducting layer acting as resonator plane for the antenna device;

a second conducting layer, that is in substantial parallel with the first conducting layer, and acting as ground plane; and a dielectric body on which said first conducting layer is provided, said first conducting layer comprising two branches, and both branches in two frequency bands contribute to the matching of the antenna device, wherein the branches have been folded in order to reduce the RF coupling between the two branches.

14. A handportable phone according to claim 13, wherein the open ends of the antenna elements constituted by the branches are located away from each other.

15. A handportable phone according to claim 13, wherein the currents running in the two antenna elements constituted by the branches are aligned at 90 degrees angle.

16. A handportable phone having a dual band antenna device comprising:

a first conducting layer acting as a resonator plane for the antenna device;

a second conducting layer, that is in substantial parallel with the first conducting layer, and acting as ground plane; and a dielectric body on which said first conducting layer is provided, said first conducting layer comprising two branches, and both branches in two frequency bands contribute to the matching of the antenna device, wherein the dielectric body is provided by a two shots injection-molding process.

17. A handportable phone according to claim 16, wherein the first conducting layer acting as resonator plane is coated onto the dielectric body.

18. A handportable phone according to claim 16, wherein feeding means of the antenna device comprises two strip—one connecting the second conducting layer to ground and one connecting the first conducting layer to a signal source.

19. A handportable phone according to claim 16, wherein the feeding means of the antenna device are located in parallel close together.

20. A dual band antenna device for a handportable phone having:

a first conducting layer acting as resonator plane for the antenna device;

a second conducting layer, that is substantially parallel with the first conducting layer, and acting as ground plane;

a dielectric body on which said first conducting layer is provided;

said first conducting layer comprises two branches;

a first one of said two branches acts as a quarter-wave resonant antenna element in a first one of two frequency bands, and as half-wave resonant antenna element in a second one of said two frequency bands; and a second one of said two branches provides a resonant matching element for the resonant antenna element provided by the first one of said two branches in each of said two frequency bands.

21. A dual band antenna device according to claim 20, wherein said second one of said two branches provides a resonant matching in said first one of said two frequency bands and a quarter-wave resonant stub in said second one of said two frequency bands.

22. A dual band antenna device according to claim 20, wherein said two frequency bands have center frequencies at approximately 920 MHz and at approximately 1800 MHz, respectively.

23. A dual band antenna device according to claim 23, wherein the branches have been folded in order to reduce the RF coupling between the two branches.

24. A dual band antenna device according to claim 23, wherein the open ends of the antenna elements constituted by the branches are located away from each other.

25. A dual band antenna device according to claim 20, wherein the currents running in the two antenna elements constituted by the branches are aligned at 90 degrees angle.

26. An antenna device according to claim 20, wherein the dielectric body is provided by a two shots injection-molding process.

27. An antenna device according to claim 26, wherein the first conducting layer acting as resonator plane is coated onto the dielectric body.

28. An antenna device according to claim 26, wherein feeding means of the antenna device comprises two strip—one connecting the second conducting layer to ground and one connecting the first conducting layer to a signal source.

29. An antenna device according to claim 26, wherein the feeding means of the antenna device are located in parallel close together.

* * * * *